US006099379A

United States Patent [19]

Eppley

[11] Patent Number: 6,099,379

[45] Date of Patent: Aug. 8, 2000

[54] EYE ARTICLE FOR TAXIDERMY FORM

[76] Inventor: Brad A. Eppley, 205 E. Jones St., Millersburg, Ohio 44654

[21] Appl. No.: 09/154,847

[22] Filed: Sep. 17, 1998

[51] Int. Cl.[7] ..... A63H 3/38

[52] U.S. Cl. ..... 446/392; 446/389

[58] Field of Search ..... 446/392, 393, 446/389, 372, 343, 344, 345, 350

[56] References Cited

U.S. PATENT DOCUMENTS

| | | | |
|---|---|---|---|
| 1,832,743 | 11/1931 | Shuldiner | 446/392 |
| 1,943,117 | 1/1934 | Grubman | 446/389 |
| 3,601,398 | 8/1971 | Brochman | 273/DIG. 4 X |
| 3,927,881 | 12/1975 | Lemelson et al. | 473/573 |
| 4,088,319 | 5/1978 | Clarke | 473/575 |
| 4,324,066 | 4/1982 | Smith et al. | 446/389 X |
| 4,432,919 | 2/1984 | Rinehart . | |
| 4,477,500 | 10/1984 | Powell . | |
| 4,511,522 | 4/1985 | Rinehart . | |
| 4,515,340 | 5/1985 | Rinehart . | |
| 4,596,683 | 6/1986 | McKenzie . | |
| 4,629,442 | 12/1986 | Samo | 446/393 X |
| 4,639,235 | 1/1987 | Ibe . | |
| 4,642,209 | 2/1987 | Powell . | |
| 5,087,204 | 2/1992 | Thompson . | |
| 5,733,333 | 3/1998 | Samkey | 446/392 X |

FOREIGN PATENT DOCUMENTS

| | | | |
|---|---|---|---|
| 601627 | 8/1934 | Germany | 446/392 |

*Primary Examiner*—D. Neal Muir
*Attorney, Agent, or Firm*—Daniel D. Wasil; Ralph E. Jocke

[57] ABSTRACT

An eye article (10) for a taxidermy form (21). The eye article includes a generally convex first surface (16) and a general concave second surface (14). The eye article is preferably injection molded of a thermoplastic material like polycarbonate and the first surface is shaped to resemble the surface of an animal eye. The eye article further includes a ring surface (20) which is adapted to fit within the taxidermy form. The eye article further includes means for providing a selected color (68) for pigmentation resembling the appearance of the desired animal eye. The color is preferably applied to the eye article via a pad printing process.

14 Claims, 5 Drawing Sheets

EYE ARTICLE FOR TAXIDERMY FORM

TECHNICAL FIELD

This invention relates in general to taxidermy, and in particular to an eye article for a taxidermy form and a method for manufacturing the eye article.

BACKGROUND ART

Prior art taxidermic eye articles are usually composed of glass. The prior art taxidermic eyes are compression molded articles which are deflashed by hand, hand-painted, and then reglazed. This prior art process for creating taxidermic eyes is expensive and technique intensive. This can result in inconsistent taxidermic eye diameters which are undesirable. Also, the prior art process is time consuming which limits the supply of taxidermic eyes and keeps the prior art taxidermic eye market price expensive. The prior art taxidermic eyes are aesthetically attractive in that they appear to match the natural coloration of the animal eyes which they represent.

Still, there exists a need in the prior art for an eye article for a taxidermic form which can be mass-produced, which can reproduce the shape and natural coloration of the animal eyes they represent, and which can be produced with consistent dimensions for a relatively inexpensive price.

DISCLOSURE OF THE INVENTION

It is an object of the present invention to provide an eye article for a taxidermic form which can be mass-produced.

A further object of the present invention is to provide an eye article for a taxidermic form which is inexpensive to produce.

A further object of the present invention is to provide an eye article for a taxidermic form which appears as an accurate representation of the shape and natural coloration of the eye of the animal.

A further object of the present invention is to provide an eye article for a taxidermic form which can be used for any size animal eye.

A further object of the present invention is to provide an eye article for a taxidermic form which consistently has a similar diameter, size, and shape, and consistently and accurately fits within the recess in the taxidermic form.

Further objects of the present invention will be made apparent in the following Best Modes For Carrying Out Invention and the appended claims.

The foregoing objects are accomplished in a preferred embodiment of the invention by an eye article for a taxidermy form, which comprises a plastic, generally hemispherical member. The member includes a generally convex first surface, a hollowed portion, and a concave second surface positioned adjacent said hollowed portion. The member is composed of polycarbonate, acrylic or other plastic which is clear, and can be molded to a smooth finish. The member allows light to be transmitted through the first surface to the second surface without substantial distortion.

The member is molded, and in one embodiment of the invention the member is injection molded. The injection molding process allows the member to be formed into a complex shape resembling the eye of an animal. In an alternate embodiment, the outer surface of the eye is shaped aspherically. The first surface includes a raised portion to resemble the iris of the animal eye.

The member preferably further includes a ring surface. The ring surface extends between the first surface and the second surface. In most animal forms, the eye article is inserted into a generally circular or oval slot. The ring surface is adapted to fit within the slot when the eye article is positioned in the form.

The member preferably further comprises a selected color wherein said selected color imparts pigmentation to the member resembling the eye pigmentation of the animal. In a second embodiment of the invention, the selected color comprises a pigment applied to the second surface by pad printing. The selected color further comprises additional pigment applied to the first surface by pad printing.

In the pad printing process, the pigment comprises preferably at least three different color pigments, wherein each of said different color pigments is applied to the surface of the member separately. The selected color comprises a predetermined pigmentation configuration derived from the imaging of an animal eye.

In one embodiment of the present invention, the selected color comprises a pigmented film positioned within the member during the molding of the member. This alternative selected color also preferably comprises a predetermined pigmentation configuration derived from the imaging of an animal eye.

In another embodiment of the present invention, the selected color comprises a pre-pigmented inner member which is positioned adjacent the member. The inner member comprises a colored flat surface which imparts the image of an iris of an animal eye.

The member further comprises a coating portion, wherein the coating portion is applied onto the member after the selected color is applied to the member.

In manufacturing an eye article for the taxidermy form, the method comprises the step of first creating a mold. The mold includes a cavity with a back face and a front face. Both the back face and the front face are generally hemispherical, but may include an oval or elliptical shape. Plastic is injected into the mold and allowed to cool, where it hardens into a formed member within the mold. The mold is then broken or separated and the formed member is removed. The formed member comprises a first face formed by the back face, and a second surface formed by the front face.

The method of making the eye article in accordance with the present invention further comprises the step of applying a selected color to the formed member. In the preferred embodiment of the invention, the applying step further comprises the steps of: inking a plate with an ink, engaging a pad with the plate wherein the ink is transferred to the pad, pressing the pad onto the first surface to impart the ink onto the first surface.

In the inking step, there are preferably at least three plates, each of which is inked with a different color ink. The inking, engaging and pressing steps are repeated at least three times until each plate is inked with its respective different color and each different color is pressed onto the back surface by the pad.

In the method of the present invention for making the eye article, each plate is prepared by the steps of first imaging an eye of an animal, then digitizing the image with a computer. The image is enhanced with the computer so that the ink from the two dimensional flat plate is properly projected onto the three dimensional concave first surface. The projected image is then separated into a plurality of separate chromatic images, wherein each chromatic image contains a plurality of points which represent a range of color spectrum of the projected image.

After each of the chromatic images are prepared, wax is applied to each plate. The computer interfaces with a laser to cut the wax on each plate for reproducing the plurality of points of the chromatic image. Each plate is then exposed to an etching solution which pits the plate where wax was removed by the laser. Thus each plate is etched with a chromatic image.

The method of the present invention further colors the second surface with the steps of inking a plate with ink, engaging a pad with the plate wherein the ink is transferred to the pad, and pressing the pad onto the front surface to transfer the ink onto the front surface.

In an alternative embodiment of the invention, the applying step comprises the steps of: coloring a film with the image of an animal eye; and inserting the film within the mold prior to the injecting step.

In still another alternative embodiment of the invention, the back surface comprises a colored inner member about which the member is molded.

After the member is colored, the entire surface of the formed article is preferably coated with a protective coating such as a UV coating for example. The coating is cured on the member by exposing the coated formed article to UV radiation for a specified time period.

BRIEF DESCRIPTION OF DRAWINGS

A preferred embodiment of the invention, an eye article for a taxidermic form, is described herein in detail with particular reference to the accompanying drawings.

BEST MODES FOR CARRYING OUT INVENTION

Figure 1A:
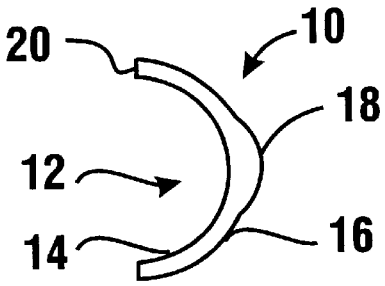
FIG. 1(A) is a cross-sectional view of the eye article of the present invention.
Figure 1B:
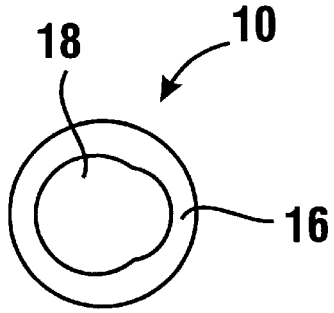
FIG. 1(B) is a front elevational view of the eye article of the present invention.

Referring now to the drawings where like numerals designate like or similar features throughout the several views, and particularly to FIGS. 1(*a*) and 1(*b*), there is shown an eye article 10 of the present invention. The eye article 10 comprises a generally hemispherical member which preferably has a circular shape, but may have an oval or elliptical shape. Eye article 10 includes a hollowed portion 12. The eye article 10 further includes a concave surface 14 which forms the hollowed portion 12 of the eye article. Eye article 10 further includes a convex surface 16 which extends opposite and substantially adjacent the concave surface 14. Convex surface 16 is shaped to resemble an animal eye. The animal can be warm blooded animals or cold blooded animals such as fish. The convex surface 16 includes a raised portion 18 positioned generally centrally on the convex surface 16. The raised portion 18 is shaped to resemble the iris of the animal and can be shaped in various configurations depending on the animal form in which the eye article will be placed. The eye article 10 further includes a ring surface 20 which extends about the circumference of the eye article. The ring surface 20 divides the convex 16 and concave 14 surfaces and extends as a wall to both the convex and concave surfaces.

Figure 2:
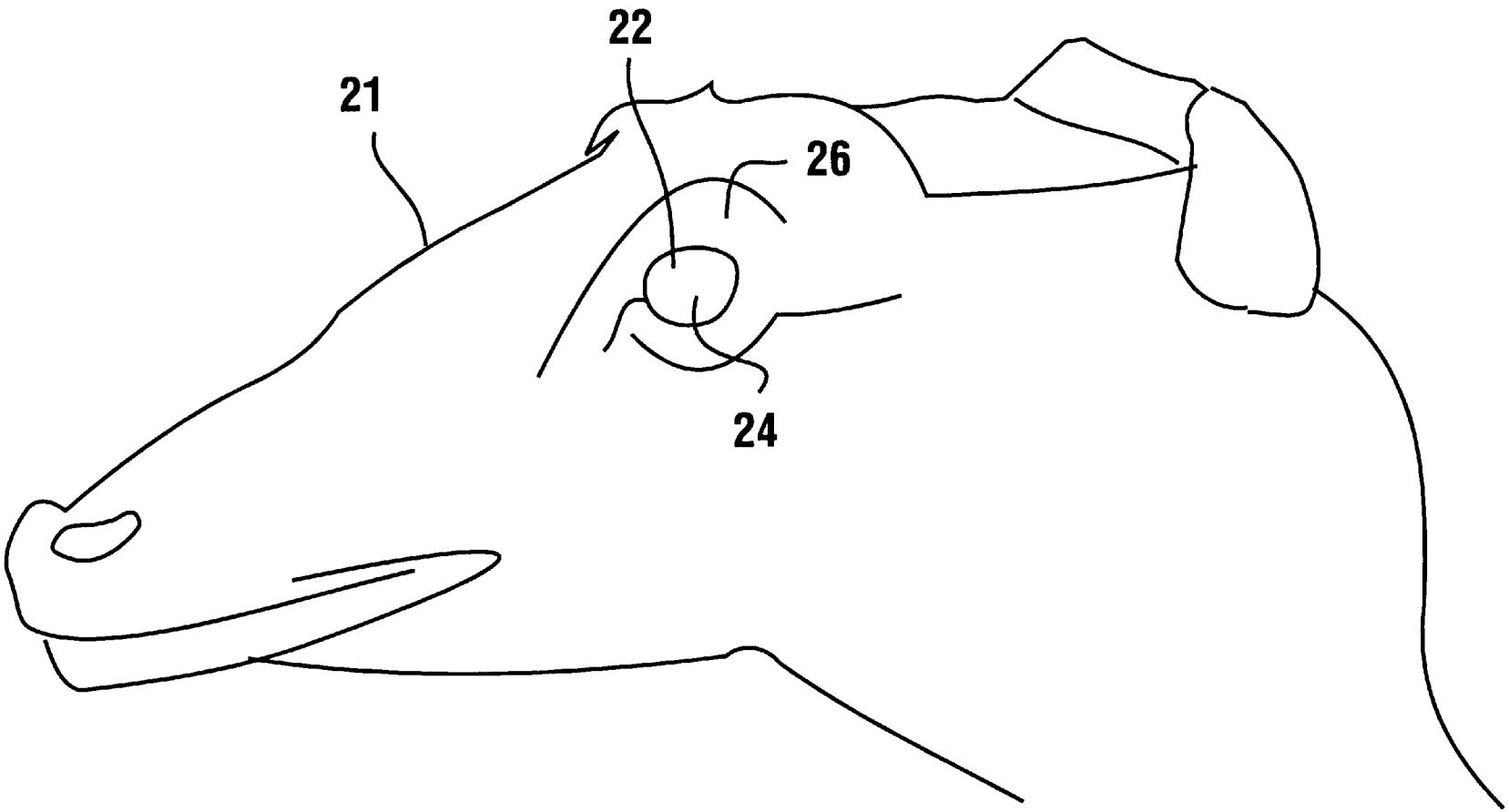
FIG. 2 is a side elevational view of a taxidermy animal form showing the circular slot for the insertion of the eye article of the present invention.

Referring now to FIG. 2, there is shown a taxidermy animal form 21. It should be understood that the present invention is applicable to any taxidermic animal form including a fish form. The ring surface 20 is constructed for engagement with a circular slot 22 positioned in the taxidermy form. The circular slot 22 comprises a flat circular area 24 surrounded by a protruding area 26. The circular slot 22 is positioned and oriented on the taxidermy form so that when the eye article 10 is placed within the circular slot and secured thereto, the eye article projects the image of an animal eye in this example.

In each embodiment of the invention, the eye article 10 is preferably composed of polycarbonate material. The polycarbonate material gives the eye article a clear appearance to visible light, and provides impact and scratch resistance. Of course, the eye article 10 may be constructed of other thermoplastic materials. The surfaces of the eye article are preferably coated with an acrylic coating to add further scratch resistance to the eye article and provide a shiny appearance naturally associated with the eye. The eye article 10 is pigmented with a selected color to render the appearance of the eye article like that of a desired animal eye.

Figure 3:
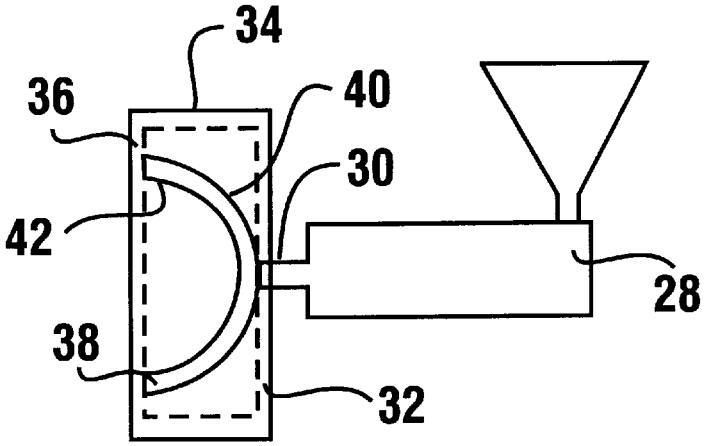
FIG. 3 is a schematic view of an injection molding press and the mold of the present invention.

Referring now to FIG. 3, there is shown an injection molding press 28 preferably used in the manufacture of the eye article 10. The injection molding press 28 is operative to force a liquefied thermoplastic material through a sprue 30 into a mold 32 for the eye article. The mold 32 is composed of two mother mold halves 34 and 36. A cavity 38 is formed within the mold 32 by front insert 40 and back insert 42. The inserts 40 and 42 are fixedly engaged within the mother mold halves 34, 36 and comprise grooves or channels allowing fluid communication between the cavity 38 and the sprue 30. The grooves are arranged to inhibit flash in the final molded product.

The mother mold halves 34, 36 are preferably made of a metal like steel, whereas the inserts 40 and 42 are preferably beryllium copper inserts. Beryllium copper is corrosion-resistant and results in a very smooth-finished injection molded product. The injection molding press 28 can comprise any size or tonnage press. The preferred embodiment of the injection molding press is a 15 ton press.

In operation, upon closure of the two mother mold halves 34 and 36, a reciprocating screw within the injection molding press 28 forces a thermoplastic material like liquid plastic polycarbonate into the sprue 30. Continuous pressure from the screw forces the polycarbonate into the grooves of inserts 40, 42 then into the cavity 38. After the polycarbonate solidifies, the molds are opened. The finished eye article is then ejected, and the process repeated for more eye articles. The eye article ejected from the mold resembles the eye article 10 described in FIGS. 1(*a*) and 1(*b*). No deflashing, polishing or other finishing steps are necessary.

Figure 4:
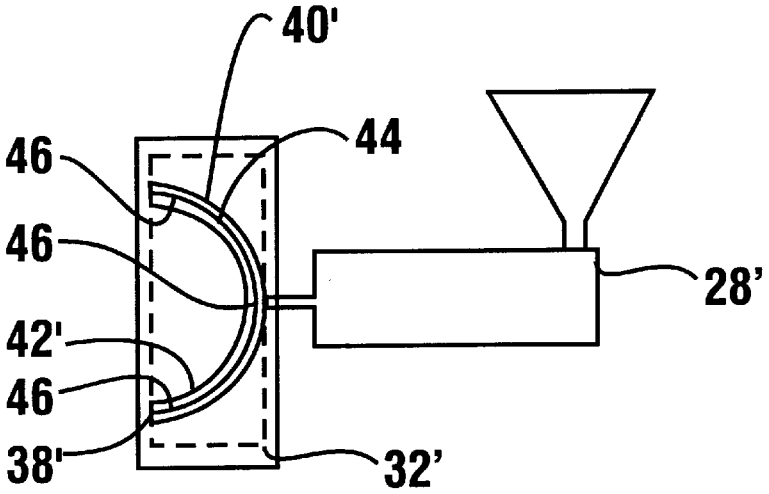
FIG. 4 shows a schematic view of an injection molding press and a mold in an alternative embodiment with an alternative coloring process.

After its formation, a selected color is added to the eye article 10. FIG. 4 depicts the manufacturing process of the eye article 10 in accordance with one embodiment of the present invention that includes a means for providing a selected color.

In FIG. 4, there is shown a mold and injection molding press similar to that of FIG. 3. For clarity purposes, similar elements use similar reference numerals but have a prime. A pigmented film 44 is placed in the cavity 42' of the mold 32'. The preferred composition of the film 44 is MYLAR® a registered trademark of the DuPont Company. However, a metal foil film has also been found to be satisfactory. The film is pre-pigmented with a photo image of the desired animal eye. Prior to the injection of the thermoplastic material such as liquefied polycarbonate, the film 44 is positioned within the cavity 42'. The film 44 is preferably generally circular and positioned substantially centrally between insert 40' and 42'. The film 44 is maintained within the cavity 38' in this position via a plurality of keys 46 which comprise small members of thermoplastic material such as polycarbonate members, to hold the film 44 in a fixed position during the injection process. The keys 46 become incorporated into the finished molded eye article. Once the film is positioned within the cavity 38', the manufacturing process of the eye article proceeds as described above with reference to the embodiment depicted in FIG. 3. After the polycarbonate member hardens, the eye article is ejected from the mold. Film 44 remains within the eye article. Visible light, transmitted through the eye article, is absorbed and reflected by the film 44.

In another embodiment of the process of the present invention in applying a selected color to the eye article, the pigmentation is added to the eye article after the formation of the eye article. In this embodiment, a selected color is applied with a multi-color pad printing process. A suitable pad printing process and apparatus are available from Teca-Print AG at 8240 Thayngen, Switzerland. An alternative pad printing process consists of the transfer of each chromatic image to the eye article from a separate inked plate also available from Teca-Print AG.

Figure 5:
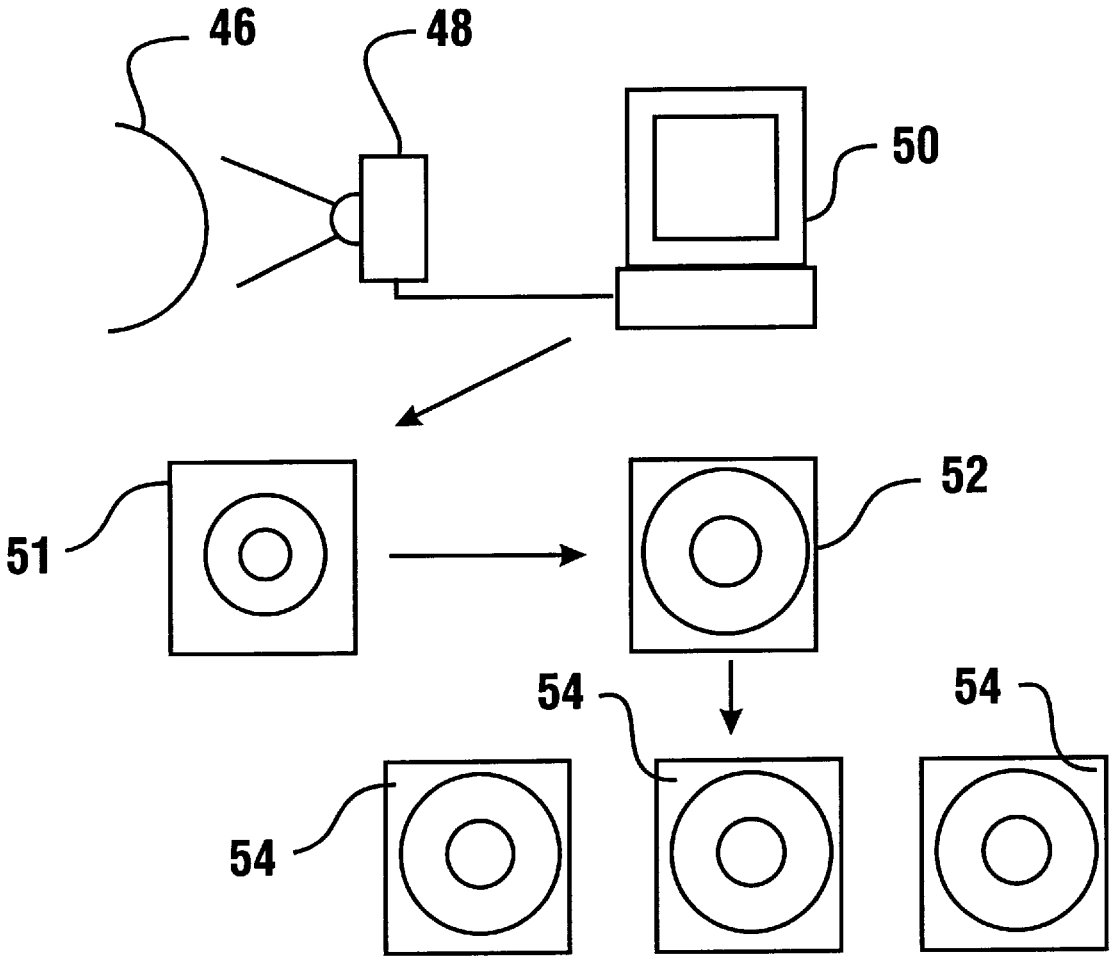
FIG. 5 is a schematic illustration of the process for creating chromatic images of the eye article from an imaged picture of an animal eye.

Referring to FIG. 5, there is shown a schematic of the manufacturing steps that make up the manufacturing of each of the separate chromatic images. The process of creating the chromatic images for the pad printing process is initiated by taking a photograph of a desired animal eye 46. The photograph of the animal eye 46 is taken with an imaging device such as camera 48. The imaging camera 48 preferably sends a digital representation of the image of the animal eye to a computer 50, or a microprocessor controlled system capable of processing the image.

The pad printing process, as known in the printing art, entails the transfer of an inked image from a plate on which an image has been etched. In the present invention the concave surface of the eye article is etched or formed into a plate by any suitable means which would include laser etching. Because the image is generally two-dimensional, whereas a concave surface is three-dimensional and substantially hemispherically shaped, the digital image must be processed and refined so that it can be accurately projected onto a three-dimensional concave surface. The computer takes the digital image 51 and performs the required image correction and processing to create a projected image 52. The computer 50 then separates the projected image 52 into separate chromatic images 54.

In this embodiment of the pad-printing process in accordance with the invention, the projected image 52 is separated into three chromatic images 54 by the computer. Each chromatic image is associated with a particular color of the pad-printing process. Once the chromatic images 54 are created, the transfer of the chromatic images is made with any suitable means onto plates for the pad printing process.

Figure 6:
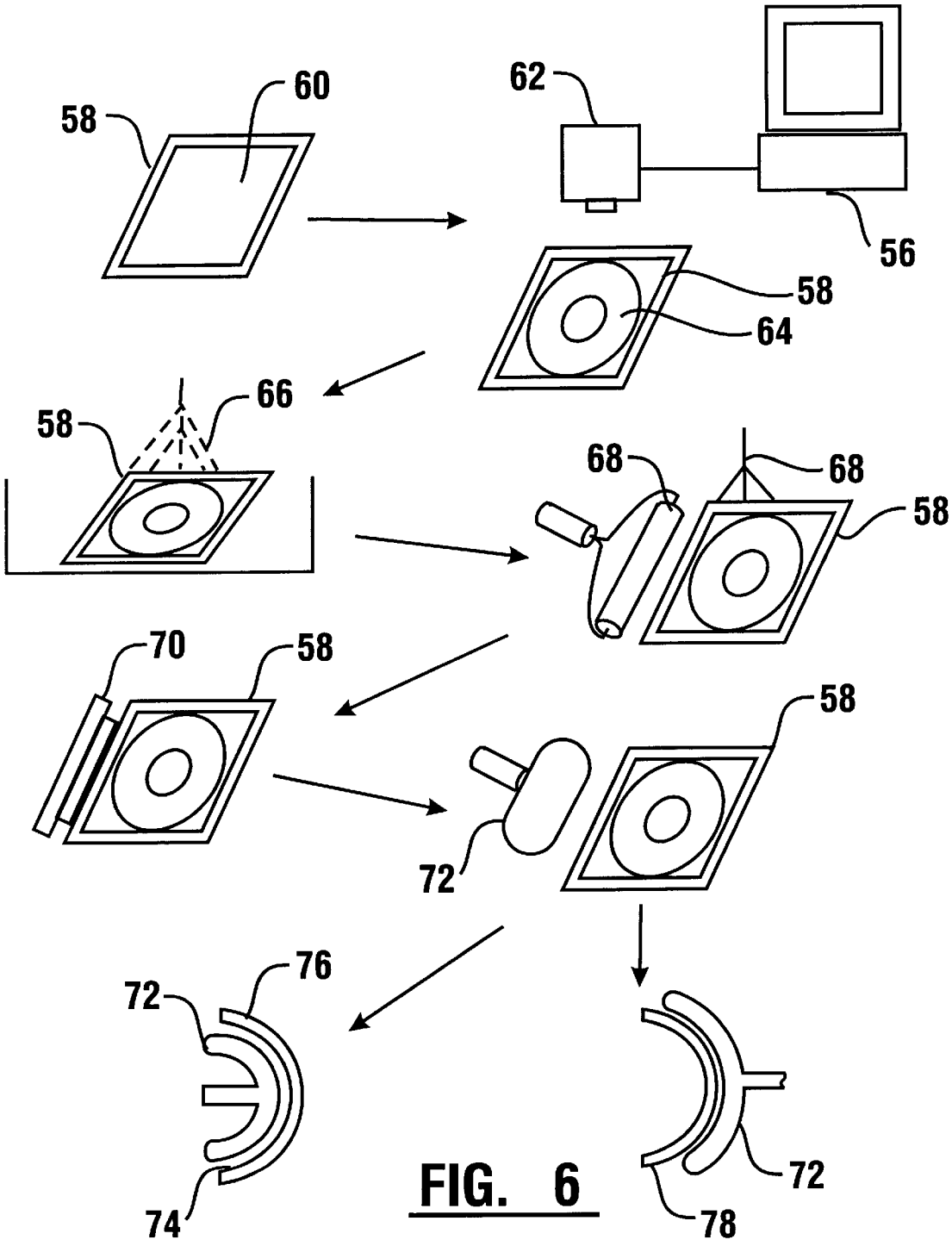
FIG. 6 shows a schematic illustration of the process for providing a selected color for the eye article of the present invention.

Referring now to FIG. 6, there is shown a schematic view of the process of the plate preparation and the transfer of the image from the plate to the eye article. As described above with regard to FIG. 5, a second computer 56 receives and contains each of the chromatic images created from the digital image of the animal eye from the first computer 50. It should be understood that a single computer may be employed to perform both functions of computers 50, 56 if desired. A plate 58 is initially covered with a film capable of being etched like a wax paper 60. Computer 56 is in electronic communication with a laser 62 which acts to remove determined portions of the wax paper 60 on the plate 58 to reproduce the chromatic image 54 which is stored inside the computer. The lightly pigmented portions of the chromatic image are reproduced by lightly scoring the wax paper. The densely pigmented areas of the chromatic image are reproduced by a heavy scoring of the wax paper.

The plate 58 with the scored image 64 is then sprayed as is known in this art with an etching solution 66 which pits the surface of the plate in the scored areas of the wax paper. In the lightly scored areas the etching solution barely penetrates the wax paper and in these areas the plate is only barely etched. In the heavily scored areas the etching solution quickly passes through the wax paper and the plate is deeply scored by the etching solution. After the etching solution has been in contact with the plate for a pre-specified time, long enough to etch the plate to the desired depth, the etching solution 66 is rinsed from the plate along with the wax 60, rendering the plate in condition for inking.

The pad-printing process allows the transfer of fluid ink contained in the etched areas of the plate to the concave surface of the eye article while the projecting non-etched areas on the surface of the plate are kept free of ink by constant wiping. The density of the ink transferred at each point depends on the depth of the etched surface at that point and the quantity of ink it contains. Ink of sufficient fluidity is used to allow direct inking of the plate without the use of a roller to spread and distribute it. Alternatively, ink 68 can be transferred to the plate via a roller. A wiping mechanism 70 is used between inking and printing. The wiping mechanism 70 consists of a thin blade preferably of soft steel, also referred to as a doctor blade, to move slowly back and forth lengthwise across the plate. By rubbing the plate with a precisely regulated degree of pressure, the doctor blade causes the excess ink to drop off from the non-etched surfaces of the plate.

After the non-etched surfaces have been wiped substantially clean of ink, the plate is ready for the ink to be transferred from the plate to the eye article. To accomplish this, a silicone rubber pad 72 is used. The pad 72, which has a greater than the surface area of the etched image, is pressed onto the surface of the plate. The ink is transferred from the etched surfaces of the plate to the surface of the pad. The pad is then pressed onto the concave surface 74 of the eye article 76. The ink from the pad is transferred to the concave surface when the pad is pressed onto said surface. This process of inking, removing the excess ink, and transferring the ink to the pad, and finally pressing the pad onto the eye article is repeated for each of the color plates. Although in this example three colors are utilized, it should be understood that any number of colors may be utilized in order to obtain a desired pigmentation.

The convex surface 78 of the eye article can also be pigmented using the above process. In coloring the convex surface 78, two plates are prepared for the colors; a first plate containing the color white and the second plate containing the color brown. White is added to the convex surface to color the sclera portion of the eye. The brown is added to the convex surface to color the limbus band of the eye article. The iris area of the convex surface is not colored. Plates are prepared for the brown and white colors in the same manner as described above. The plates are inked and scraped in the same manner as described above. The ink from the plates is applied to the convex surface in the same manner as described above.

Figure 7:
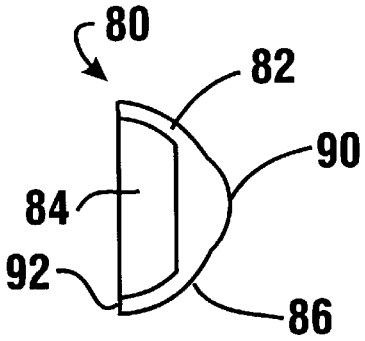
FIG. 7 shows a cross sectional view of another embodiment of the eye article of the present invention.
Figure 8:
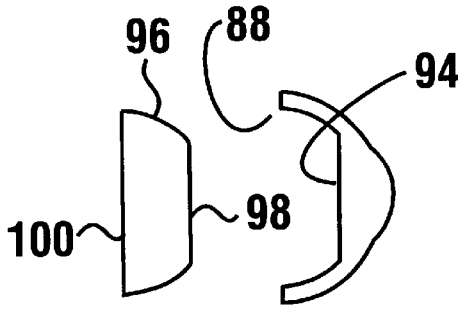
FIG. 8 is a view similar to FIG. 7 showing the inner and outer members.
Figure 9:
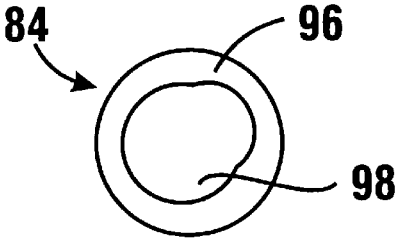
FIG. 9 is a front view of the inner member of an embodiment of the eye article of the present invention.

Referring next to FIGS. 7, 8 and 9, there is shown still another embodiment of the eye article 80 in accordance with the present invention. The eye article comprises a two part structure including an outer member 82 and an inner member 84. The outer member 82 includes a convex surface 86 which extends in a generally abutting arrangement with a concave surface 88. The convex surface 86 includes a raised portion 90 positioned generally centrally on the convex surface 86. The raised portion 90 is shaped to resemble the iris of an animal eye. The eye article can be shaped in various configurations to resemble the eye of any desired warm blooded or cold blooded animal, or other life form.

The eye article 80 further includes a ring surface 92 which extends about the perimeter of the eye article. The ring surface extends between the convex and concave surfaces and is constructed for engagement with the circular slot 22 of the taxidermy form typically shown in FIG. 2. The concave surface 88 includes a depressed area 94 which is positioned substantially centrally on the eye article and extends generally parallel with the ring surface 92. The outer member 82 is preferably comprised of a clear thermoplastic material like polycarbonate. The convex surface of the outer member 82 is preferably coated with a scratch resistant coating like an acrylic coating to add further scratch resistance.

The inner member 84 comprises an achromatic surface 96 which extends about the perimeter of the inner member. The achromatic surface is generally convexly shaped for mating with the concave surface 88 of the outer member. The inner member further comprises a pigmented surface 98 which is generally planar. As shown in FIG. 9, the pigmented surface is acircular and shaped to resemble an iris of an animal eye which it simulates. The depressed area 94 of the outer member is shaped to mate with the pigmented surface. The inner member further comprises a base surface 100. The base surface extends generally parallel from the pigmented surface and is also generally planar. When the inner member is positioned within the outer member as depicted in FIG. 7, the base surface 100 is positioned flush with the ring surface 92. Alternatively, the base surface 100 can be disposed from the ring surface to extend generally normal with the convex surface. The shape of the base surface 100, although depicted planar, can be alternatively convex so as to minimize the material required for the inner member.

The inner member 84 preferably includes a selected color for the eye article. The inner member is preferably injection molded from a white pigmented thermoplastic material. The thermoplastic is preferably a polycarbonate although other thermoplastics and thermosetting resins can also be suitable. The white pigmentation of the inner member allows the achromatic surface to be viewed as white. The coloring of the iris of a desired animal is added to the pigmented surface. Pigmentation of the inner member is visible through the clear outer member so as to resemble the eye of a desired animal.

Color can be added to the pigmented surface of the inner member through many methods. In a preferred embodiment of coloration of the pigmented surface, pad printing is used to impart pigment resembling the iris of the desired animal. The pad printing process as described above with reference to FIG. 6 was processed to accommodate a two dimensional image for projection onto a three dimensional surface. The use of the inner member 84 along with a generally planar pigmented surface allows for a simplified pad printing process in which processing of the two dimensional image is not normally required. The pad printing process applicable to the pigmentation of the pigmented surface is well known in the art. It comprises creation of a multiplicity of colored plates from a digital image of the iris of the desired animal. The colors are then either separately added from their respective plates to the pigmented surface, or multi-color printing is also feasible.

Alternatively, color can be added to the pigmented surface via a hot stamping process, application of a decal, or any like process. In the application of a decal, a film made from a digital image of the iris of a desired animal is affixed to the pigmented surface. The film can be comprised of a MYLAR® or other plastic or metal film. Methods for making these decals from digital images are well known in the art.

After the inner member 84 is pigmented, it may be combined with the outer member 82 to form the eye article. In the preferred method of forming the eye article 80, a preformed polycarbonate outer member 82 is inserted over the pigmented surface and achromatic surface of an inner member 84. The concave surface mates with the achromatic surface while the depressed area 94 mates with the pigmented surface 98. The inner member and the outer member are fixed to each other with an adhesive. A thermoplastic adhesive such as an epoxy derived adhesive can be applied to the achromatic surface 96 prior to the outer and inner members being pressed together to form the eye article. Alternatively, a clear coat resin adhesive can be added over the surface of the inner member and the eye article can be heated to cure the clear coat resin adhesive while the outer and inner members are secured together.

Figure 10:
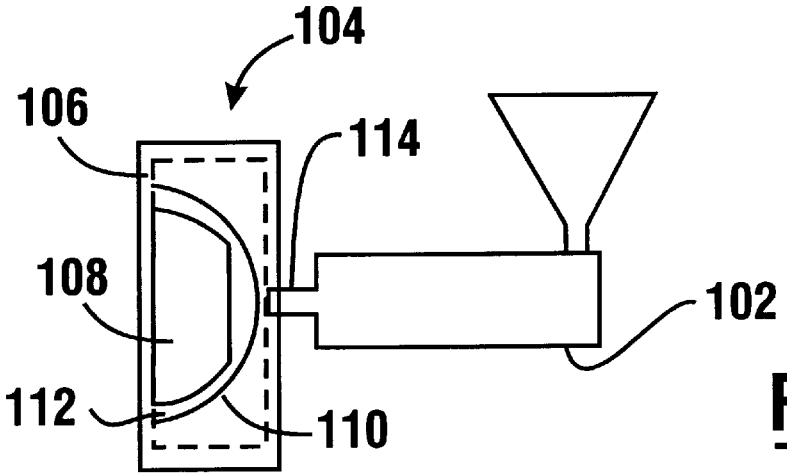
FIG. 10 is a schematic view of an injection molding press and a mold for an alternative embodiment of the present invention making a selected color.

An alternative method of forming the eye article 80 is to form the outer member 82 over the inner member 84. Referring to FIG. 10, there is shown a schematic view of an injection molding process. An injection molding press 102 is in fluid communication with an injection mold 104. The injection mold 104 comprises a mother mold 106 which contains a formed inner member 108, the inner member having been previously formed and pigmented as earlier described. Inner member 108 is bounded by insert 110 within the mother mold. The insert 110 is constructed to form the convex surface of the outer member 82. Insert 110 and the outer surface of the inner member 108 form a cavity 112 within the mother mold. The cavity is positioned in fluid communication with the injection molding press via a sprue 114. In operation, the clear polycarbonate resin is melted and injected through the sprue 114 into the cavity to form the outer member. During the molding process the outer member forms about the surface of the inner member to make a composite eye article.

While an injection molding process has been disclosed, the eye article of the present invention may be formed from any suitable technique including but not limited to injection molding, compression molding, or blow molding.

Similarly, the eye article may be given color by any suitable means, for example, a decal may be used to cover the first convex surface and then a clear coating formed over it. The clear coating may be a UV coating or silicone based and sprayed or dipped on the eye article. The coating may be baked on or even cured with UV.

The eye article is formed of a thermoplastic material which includes but is not limited to any plastic, polymer material or polymer/blends. The term thermoplastic material as used herein is further meant to include thermosetting materials.

Thus the present invention achieves the above-stated objectives and eliminates difficulties encountered with the use of prior devices, solves problems and attains the desired results described herein.

In the foregoing description, certain terms have been used for brevity, clarity and understanding. However, no unnecessary limitations are to be implied therefrom because such terms are used for descriptive purposes and are intended to be broadly construed. Moreover, the descriptions and illustrations herein are by way of examples and the invention is not limited to the exact details shown or described. Further, in the following claims any feature that is described as a means for performing a function shall be construed as encompassing any means capable of performing that function and shall not be limited to the particular means shown in the foregoing description or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

I claim:

1. An eye article for a taxidermy form, comprising:

a thermoplastic generally hemispherical member, said member including a first surface and a second surface, said first surface being generally convex, said second surface being generally concave, said second surface being spaced from said first surface, and said second surface having a depressed area positioned generally centrally therein, said member being constructed of a material that allows light to be transmitted through said first surface, means for providing a selected color, wherein said color providing means imparts a desired pigmentation to an outer surface of the member, whereby said eye article pigmentation resembles a predetermined natural eye pigmentation, an inner member, the inner member having a generally convex surface and a generally planar pigmented surface, wherein said second surface being constructed to receive the inner member inserted therein, and wherein the depressed area is adapted to mate with the pigmented surface.

2. The eye article of claim 1 wherein said first surface is generally aspherically shaped to mimic eye shape of an animal.

3. The eye article of claim 1 wherein said thermoplastic member is constructed with a molding process selected from the group consisting of injection molding, compression molding, and blow molding.

4. The eye article of claim 1, wherein the generally concave second surface is adapted to mate with the generally convex surface of the inner member while the depressed area mates with the pigmented surface.

5. The eye article of claim 1 wherein said first surface includes a raised portion positioned approximately centrally thereon.

6. The eye article of claim 1 wherein said thermoplastic member is composed of a member selected from the group consisting of acrylic and polycarbonate.

7. The eye article of claim 1 wherein said thermoplastic member has a ring surface, said ring surface extending adjacent said first surface, wherein said taxidermy form comprises a generally circular slot and wherein said ring surface is engageable within said circular slot on said taxidermy form when said eye article is positioned in said taxidermy form.

8. The eye article of claim 1, wherein said first convex surface includes a raised portion positioned approximately centrally thereon, said raised portion resembling an iris of an eye of a desired life form.

9. An eye article for a taxidermy form, comprising:

a thermoplastic generally hemispherical member, said member including a first surface, said first surface being generally convex, said member being constructed of a material that allows light to be transmitted through said first surface, means for providing a selected color, wherein said color providing means imparts a desired pigmentation to an outer surface of the member, whereby said eye article pigmentation resembles a predetermined natural eye pigmentation, wherein said means for providing a selected color comprises a pigmented film positioned within said thermoplastic member, wherein the thermoplastic member comprises a molded thermoplastic member, and wherein the molded thermoplastic member includes the film embedded therein forming a unitary body.

10. The eye article of claim 9, wherein the film includes a photo image of an animal eye.

11. The eye article of claim 9, wherein said molded thermoplastic member is constructed from injection molding, compression molding, or blow molding.

12. A taxidermy system comprising:

an eye article for a taxidermy form, wherein the eye article includes a thermoplastic generally hemispherical member, said member including a first surface, said first surface being generally convex, said member being constructed of a material that allows light to be transmitted through said first surface, means for providing a selected color, wherein said color providing means imparts a desired pigmentation to an outer surface of the member, whereby said eye article pigmentation resembles a predetermined natural eye pigmentation, wherein said means for providing a selected color includes a laser, wherein the laser is adapted to cut, processing means for deriving pigmentation from the imaging and signal conditioning of an eye of a life form, wherein the processing means interfaces with the laser.

13. The eye article of claim 12, wherein said member further includes a second surface, said second surface being generally concave and positioned generally opposed to said first convex surface, and wherein said means for providing a selected color comprises pigment applied to said second concave surface.

14. The eye article of claim 13 wherein the pigment comprises at least three different color pigments.

* * * * *